US007677768B2

(12) United States Patent
Huang et al.

(10) Patent No.: US 7,677,768 B2
(45) Date of Patent: Mar. 16, 2010

(54) LED LAMP HAVING A CONVENIENT REPLACEMENT STRUCTURE

(75) Inventors: Xing-Gui Huang, Shenzhen (CN); Li He, Shenzhen (CN)

(73) Assignees: Fu Zhun Precision Industry (Shen Zhen) Co., Ltd., Shenzhen, Guangdong Province (CN); Foxconn Technology Co., Ltd., Tu-Chen, Taipei Hsien (TW)

( * ) Notice: Subject to any disclaimer, the term of this patent is extended or adjusted under 35 U.S.C. 154(b) by 0 days.

(21) Appl. No.: 12/202,395

(22) Filed: Sep. 1, 2008

(65) Prior Publication Data

US 2009/0257224 A1 Oct. 15, 2009

(30) Foreign Application Priority Data

Apr. 9, 2008 (CN) ..... 2008 1 0066300

(51) Int. Cl.
*F21V 29/00* (2006.01)

(52) U.S. Cl. ..... 362/294; 362/241; 362/249.02; 362/287

(58) Field of Classification Search ..... 362/240, 362/241, 249.02, 287, 294, 297, 346, 373, 362/428, 800, 97.3, 249.01, 631, 632, 633, 362/634

See application file for complete search history.

(56) References Cited

U.S. PATENT DOCUMENTS

| | | | | |
|---|---|---|---|---|
| 5,934,798 | A * | 8/1999 | Roller et al. | 362/800 |
| 7,175,329 | B1 * | 2/2007 | Chou | 362/631 |
| 2006/0098438 | A1 * | 5/2006 | Ouderkirk et al. | 362/294 |
| 2007/0103908 | A1 * | 5/2007 | Tabito et al. | 362/240 |
| 2008/0080189 | A1 * | 4/2008 | Wang | 362/241 |
| 2008/0212324 | A1 * | 9/2008 | Lin | 362/287 |

* cited by examiner

*Primary Examiner*—Y My Quach Lee
(74) *Attorney, Agent, or Firm*—Frank R. Niranjan

(57) ABSTRACT

An LED lamp for providing a relatively large luminous flux, includes a housing and a pair of LED units mounted in the housing. The two LED units are separated from each other by a clapboard set in the housing. Each LED unit includes a plate, a plurality of LED modules disposed on the plate and a cover laying on the plate and cover the LED modules. The cover forms a plurality of vents to expose LEDs of the LED modules therein. A plurality of first screws extends through the LED modules and the plate to secure them together, while a plurality of second screws extends through the plate, the cover and the housing to fix the whole LED unit to the housing. Each LED module has a printed circuit board and a plurality of LEDs on the printed circuit board.

20 Claims, 4 Drawing Sheets

LED LAMP HAVING A CONVENIENT REPLACEMENT STRUCTURE

BACKGROUND OF THE INVENTION

1. Field of the Invention

The present invention relates to an LED lamp, and more particularly to an LED lamp incorporating a plurality of LED units which can be conveniently replaced.

2. Description of Related Art

LEDs have been available since the early 1960's. Because of the relatively high light-emitting efficiency of LEDs, nowadays LED usage has been increased in popularity in a variety of applications, e. g., residential, traffic, commercial, industrial settings. Conventionally, an LED lamp comprises a housing and a plurality of LED modules mutually independently mounted in the housing via multiple screws. The housing severs as a support for fixing the LED modules thereto, as well as a heat sink for dissipating heat generated by the LED modules to an ambient atmosphere.

However, since each LED module is individually installed on a corresponding part of the housing by screws, if a certain number of the LED modules in the housing are damaged and need to be replaced, it is cumbersome to disassemble the damaged LED modules from the housing one by one. In worse cases, when the number of the damaged LED modules is large, the dissembling work becomes more difficult and would spend so many times, which is extremely undesirable if the LED lamp is particularly in the case of some emergent lighting applications where an immediate replacement is imperative.

What is needed, therefore, is an LED lamp which can overcome the above-mentioned disadvantages.

SUMMARY OF THE INVENTION

An LED lamp for providing a relatively large luminous flux, includes a housing and a pair of LED units mounted in the housing. The two LED units are separated from each other by a clapboard set in the housing. Each LED unit includes a plate, a plurality of LED modules disposed on the plate and a cover mounted to the plate to cover the LED modules. The cover forms a plurality of vents to expose LEDs of the LED modules therein. A plurality of first screws extends through the LED modules and the plate to secure them together, while a plurality of second screws extends through the plate, the cover and the housing to secure the whole LED unit to the housing. By providing the plate which serves as an interconnector between the LED modules and the housing, the LED modules can be simultaneously detached from the housing just by disassembling the plate from the housing. Thus, the replacement of the LED modules is quite easy and convenient.

Other advantages and novel features of the present invention will become more apparent from the following detailed description when taken in conjunction with the accompanying drawings.

BRIEF DESCRIPTION OF THE DRAWINGS

Many aspects of the present apparatus can be better understood with reference to the following drawings. The components in the drawings are not necessarily drawn to scale, the emphasis instead being placed upon clearly illustrating the principles of the present apparatus. Moreover, in the drawings, like reference numerals designate corresponding parts throughout the several views.

DETAILED DESCRIPTION OF THE INVENTION

Figure 1:
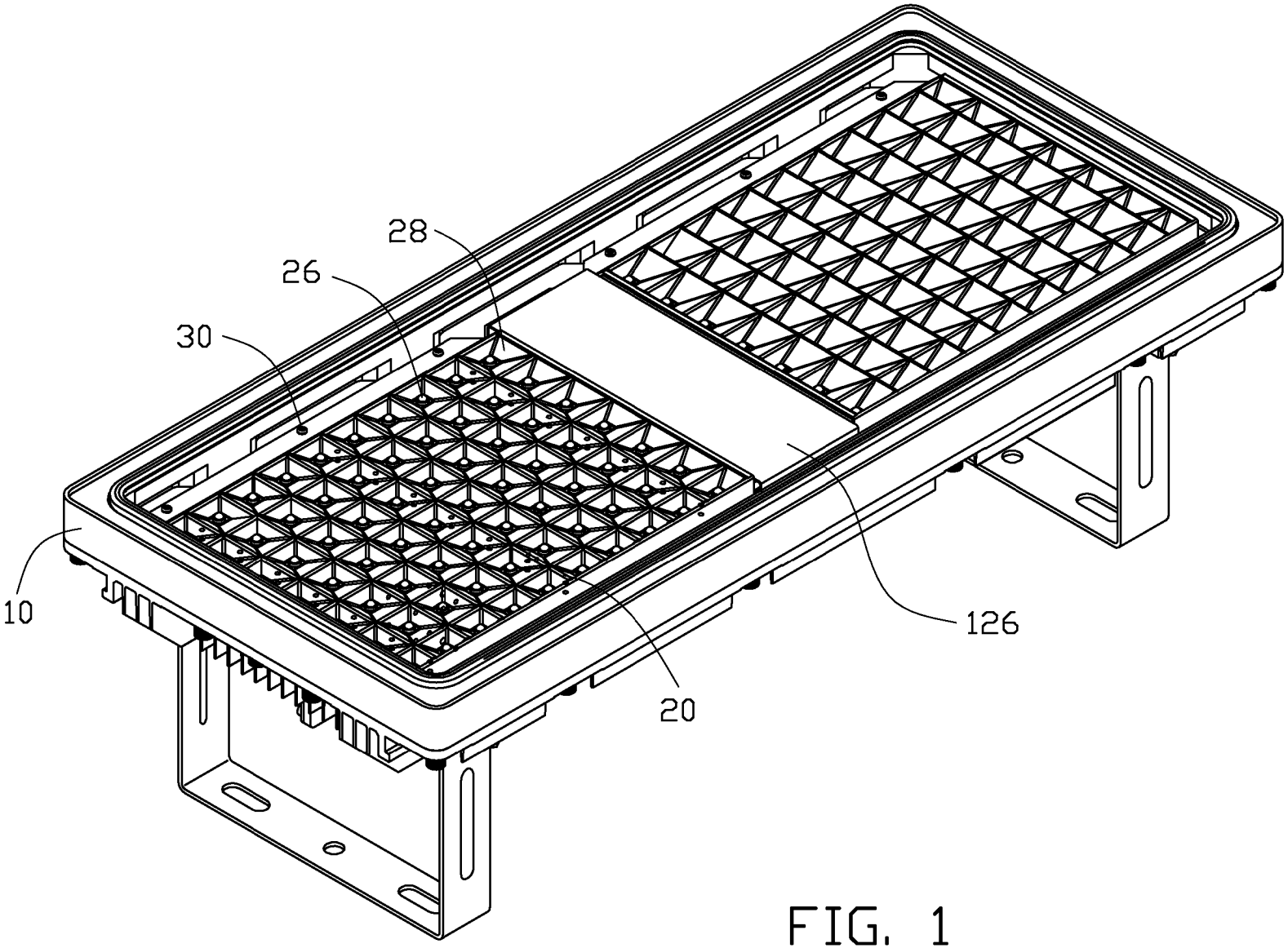
FIG. 1 is an assembled, perspective view of an LED lamp in accordance with a preferred embodiment of the present invention.

Referring to FIG. 1, an LED lamp in accordance with a preferred embodiment of the present invention is for being employed in some illuminating devices needing high luminous flux, such as a street lamp or a tunnel lamp. The LED lamp comprises a rectangular housing 10 and a pair of LED units 20 mounted in the housing 10 for emitting light out of the housing 10.

Figure 2:
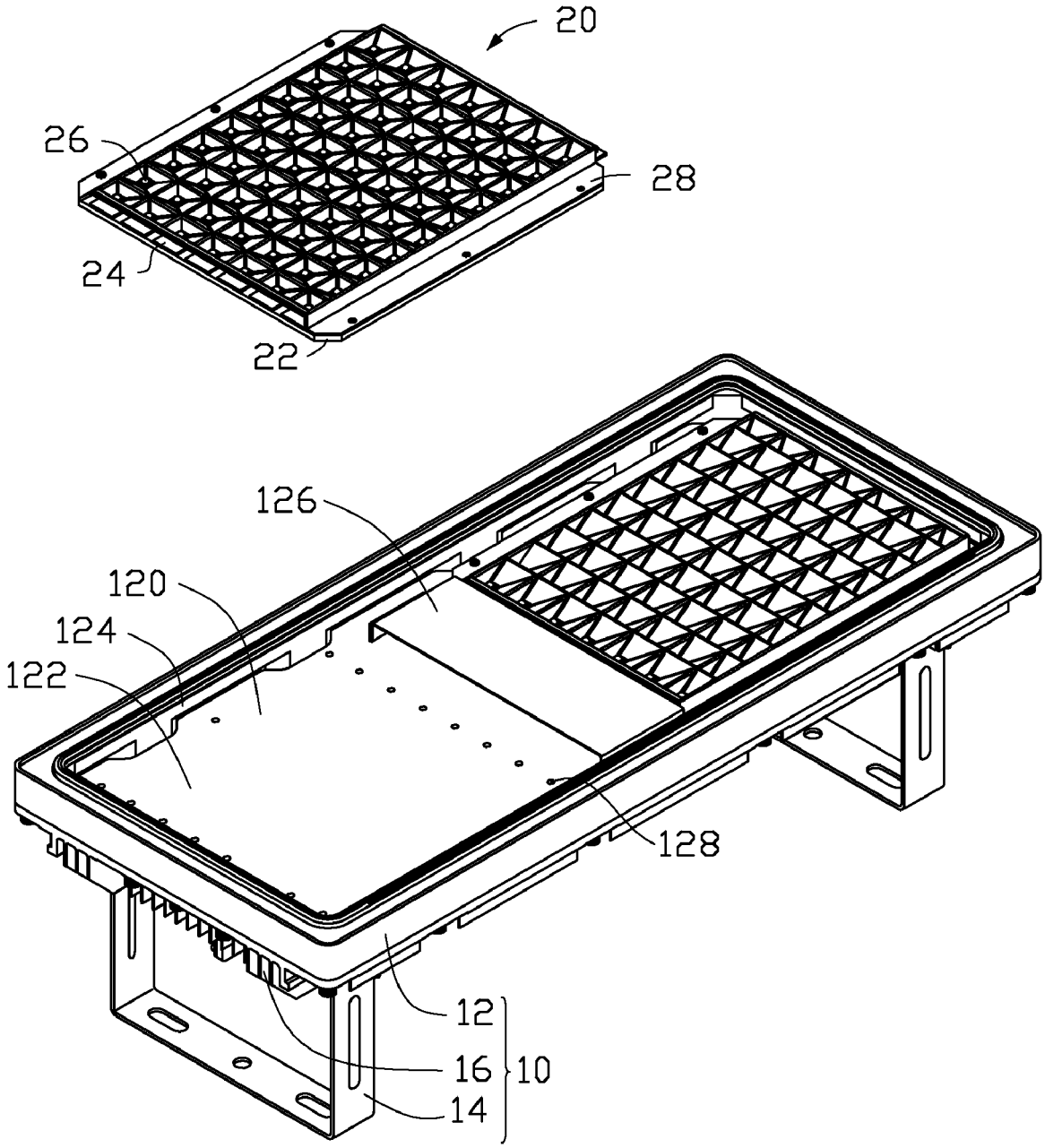
FIG. 2 is a partially exploded view of FIG. 1, wherein an LED unit is disassembled from the LED lamp for clarity.
Figure 3:
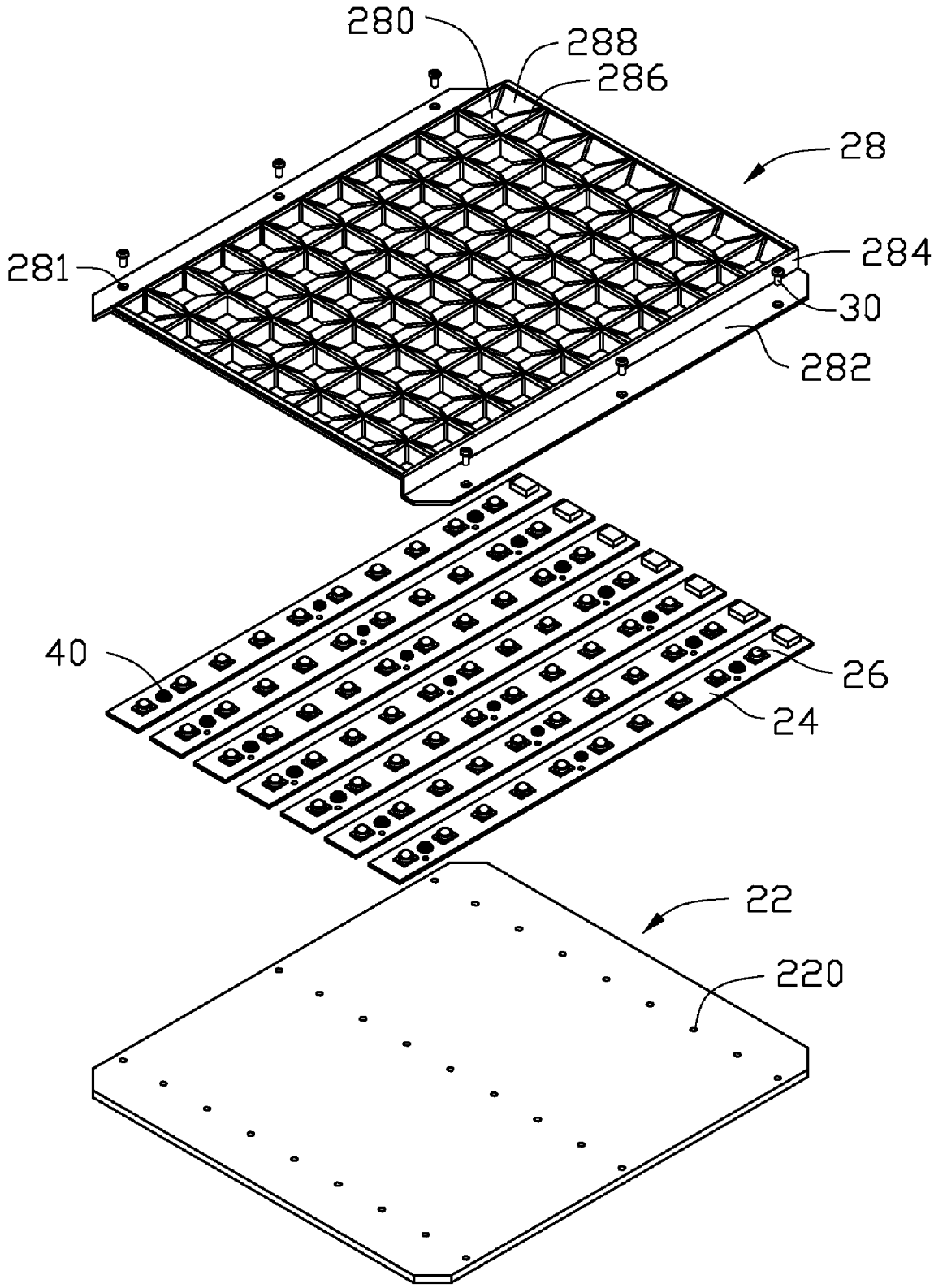
FIG. 3 is an enlarged, exploded view of the LED unit of FIG. 2.

Also shown in FIGS. 2-3, the housing 10 includes a hollow casing 12, a plurality of fins 16 extending downwardly from a bottom face of the casing 12 for dissipating heat from the LED units 20, and a pair of U-shaped arms 14 pivotably attached to the casing 12 near two opposite ends of the casing 12. The casing 12 has an inner top face 122 which is planar, and an inner circumferential face 124 surrounding the top face 122. The inner top face 122 and the inner circumferential face 124 together enclose a rectangular room 120 in the housing 10 for receiving the LED units 20. An inverted U-shaped clapboard 126 is mounted to a central area of the top face 120 of the casing 12 to separate the room 120 into two symmetrical spaces (not labeled) for respectively accommodating the two LED units 20 therein. A plurality of thread holes 128 is defined in the top face 122 of the casing 12 for extension of screws 30 therein (see FIG. 3).

Figure 4:
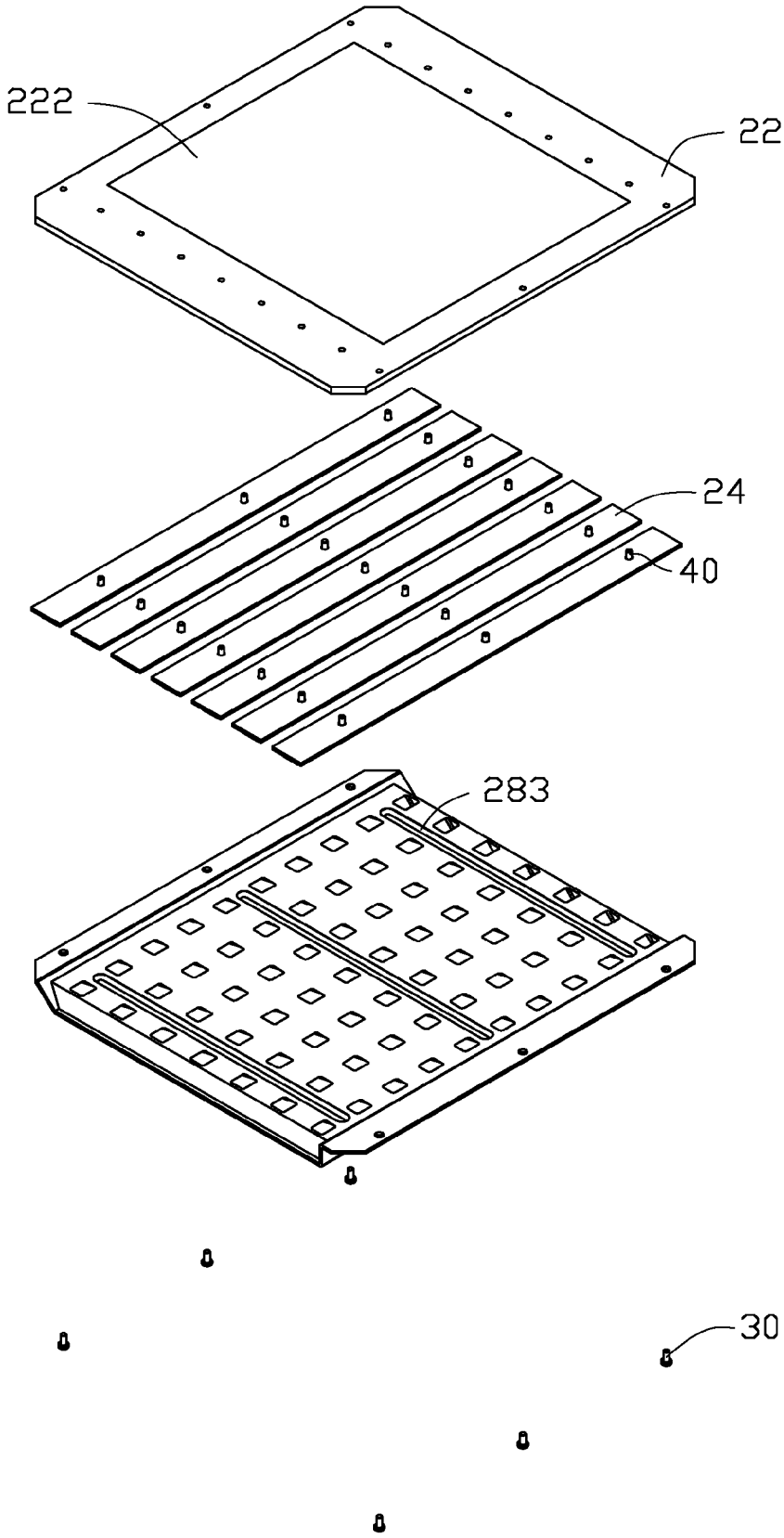
FIG. 4 is an inverted view of FIG. 3.

Also with reference to FIG. 4, each LED unit 20 is constituted of a heat-conducting plate 22, a plurality of LED modules (not labeled) secured on the plate 22, and a light-guiding cover 28 attached on the plate 22 to direct light emitted from the LED modules. The plate 22 has a square configuration with four corners thereof being truncated. A thermally-conductive adhesive layer 222 is coated on a central area of a bottom face of the plate 22 (illustrated in FIG. 4). The thermally-conductive adhesive layer 222 is used for bonding the plate 22 to the housing 10 for a purpose of a better heat conduction. A plurality of threaded holes 220 is defined in the plate 22 along three lines, for allowing the screws 30 to extend therethrough. Each LED module comprises an elongated printed circuit board 24 and a plurality of LEDs 26 equidistantly mounted on a top face of the printed circuit board 24. Each LED 26 includes an LED die (not shown) and an encapsulant (not shown) enveloping the LED die for deriving light emitting from the LED die to an outside of the LED 26. The LED die supplies a luminous flux of about 200 lumens during operation, whereby the whole LED lamp is capable of outputting the light with a relatively large lighting intensity. The plurality of LED modules is readily fixed on the plate 22 by extending three screws 40 through each LED module into corresponding threaded holes 220 in the plate 22. Particularly, after being completely fixed in the plate 22, a free end (not labeled) of each screw 40 is received in the threaded hole 220 without protruding out of the bottom face of the plate 22, for preventing a physical contact of the screws 40 with the top face 122 of the casing 12 during assembling the LED unit 20 to the housing 10, which may cause a scratch of the top face 122 of the casing 12. Three threaded holes 220 near each of forefront and rearmost sides of the plate 22 are used for mounting the cover 28 on the plate 22 by extending the screws 30 through the cover 28 and screwing the screws 30 into the plate 22.

The cover 28 comprises a screen 286, a pair of sidewalls 284 extending downwardly from two opposite sides of the screen 286, and a pair of wings 282 formed horizontally and outwardly from bottoms of the pair of sidewalls 284, respectively. The screen 286 is recessed downwardly at spots all over a top face thereof, to form a plurality of evenly distributed cups (not labeled). Each cup has four inclined interior faces 288 coupling with each other to cooperatively surround a quadrate-tapered vent 280. Each vent 280 corresponds to each LED 26. Each vent 280 is for receiving a corresponding LED 26 therein to thereby expose the LED 26 in the cover 28 when the cover 28 is assembled to the plate 22. The vent 280 has a caliber increasing upwardly, for guiding the light emitted from the LED 26 in a diffused manner. An inclined angle of each interior face 288 with respect to a vertical direction is variable according to different requirements; preferably, the angle is 45° in the present invention. Each interior face 288 of the cup is plated with a reflecting layer (not shown), thereby to sufficiently reflect the light from the LEDs 26 as much as possible. Three grooves 283 are formed in a bottom face of the screen 286 corresponding to the screws 40 fixed in the LED modules (as viewed from FIG. 4). The three grooves 283 are used for fittingly accommodating heads (not labeled) of the screws 40 therein when the cover 28 is mounted on the plate 22, thus preventing an interference from occurring between the cover 28 and the screws 40. Each wing 282 defines three threaded holes 281 in alignment with the three threaded holes 220 in each of the forefront and rearmost sides of the plate 22. Three corresponding screws 30 are extended through the three threaded holes 281 in each wing 282 and the three threaded holes 220 in the each of forefront and rearmost sides of the plate 22, to be engaged in corresponding threaded holes 128 in the casing 12, thereby securing the LED unit 20 to the housing 10. At this fixed position, the screws 40 connecting the LED modules with the plate 22 of the LED unit 20 would keep a clearance with the top face 122 of the casing 12; that is to say, the screws 40 do not have any direct contact with the housing 10.

Since the LED modules are readily mounted on the plate 22, which is then assembled to the housing 10 of the LED lamp via the screws 30, a quick replacement of the LED modules from the housing 10 can be realized. If some LED modules are required to be replaced due to malfunction, what needs to do is only to disassemble the whole LED unit 20 which incorporates the failed LED modules therein from the housing 10, and then mount a new LED unit 20 in the housing 10. By the provision of the plate 22 which functions as an intermediate between the LED modules and the housing 10, a large number of LED modules can be simultaneously dismounted from the LED lamp, and a convenient and immediate replacement of the LED modules is accordingly achieved.

It is believed that the present invention and its advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An LED lamp comprising:

a housing enclosing a room; and an LED unit substantially received in the room in the housing, comprising;

a plate; and a plurality of LED modules fixed on the plate, each LED module having a printed circuit board and a plurality of LEDs mounted on the printed circuit board;

wherein the plate is detachably secured to the housing to fix the LED modules to the housing;

wherein a plurality of fasteners extend through the LED modules into the plate, the plurality of fasteners are spaced from the housing without protruding out of a bottom face of the plate; and wherein the plate of the LED unit is bonded to the housing via a thermally-conductive adhesive layer.

2. The LED lamp as claimed in claim 1 further comprising another LED unit fixed to the housing, wherein the LED unit and the another LED unit are separated from each other by a clapboard received in the housing.

3. The LED lamp as claimed in claim 1, wherein the LED unit further comprises a light-guiding cover fixed on the plate, the LEDs of the plurality of LED modules being exposed in the light-guiding cover.

4. The LED lamp as claimed in claim 3, wherein the light-guiding cover has a plurality of spots recessed to form vents, the LEDs of the plurality of LED modules being received in the vents, respectively.

5. The LED lamp as claimed in claim 4, wherein a caliber of the vent increases along a direction remote from the LEDs.

6. The LED lamp as claimed in claim 4, wherein the vent in the light-guiding cover is enclosed by four inclined faces.

7. The LED lamp as claimed in claim 3, wherein the light-guiding cover has two opposite wings located at two flanks of the plurality of LED modules, a plurality of additional fasteners extending through the two opposite wings and the plate to be engaged in the housing.

8. The LED lamp as claimed in claim 7, wherein the light-guiding cover comprises a screen covering the LEDs and two sidewalls extending downwardly from two opposite sides of the screen, the wings being extended outwardly from bottoms of the two sidewalls, respectively.

9. The LED lamp as claimed in claim 1, wherein the housing comprises a casing receiving the LED unit, a plurality of fins extending away from the LED unit, and a pair of arms pivotably attached to the casing.

10. An LED lamp comprising:

a support; and an LED unit fixed to the support, comprising:

a plate;

a plurality of LED modules fixed on the plate, each of the plurality of LED modules comprising a plurality of LEDs; and a reflector secured on the plate to reflect light emitted from the plurality of LED modules;

wherein the plate is detachably secured to the support to realize a detachable connection between the LED unit and the support;

wherein a plurality of first fasteners extend through the LED modules into the plate, the first fasteners do not protrude out of the plate to maintain a clearance from the support; and wherein a plurality of second fasteners extend through the reflector and the plate and into the support.

11. The LED lamp as claimed in claim 10, wherein each of the plurality of LEDs includes an LED die which supplies a luminous flux of 200 lm during operation.

12. The LED lamp as claimed in claim 10, wherein a thermally-conductive adhesive layer is applied between the plate and the support to thermally bond the plate and the support together.

13. The LED lamp as claimed in claim 10, wherein the reflector has a plurality of vents defined therein, the each of the plurality of LEDs being received in a corresponding one of the plurality of vents.

14. The LED lamp as claimed in claim 12, wherein the each of the plurality of vents has an interior diameter increasing toward a direction remote from the plate.

15. The LED lamp as claimed in claim 10, wherein the reflector comprises a screen covering the LEDs, a pair of sidewalls extending downwardly from two opposite sides of the screen, and a pair of wings extending outwardly from bottoms of the sidewalls, respectively, the second fasteners extending through the wings of the reflector.

16. An LED lamp comprising:

a housing enclosing a room; and an LED unit substantially received in the room in the housing, comprising;

a plate; and a plurality of LED modules fixed on the plate, each LED module having a printed circuit board and a plurality of LEDs mounted on the printed circuit board;

wherein the plate is detachably secured to the housing to fix the LED modules to the housing;

wherein a plurality of fasteners extend through the LED modules into the plate, the plurality of fasteners are spaced from the housing without protruding out of a bottom face of the plate; and wherein the housing comprises a casing receiving the LED unit, a plurality of fins extending away from the LED unit, and a pair of arms pivotably attached to the casing.

17. The LED lamp as claimed in claim 16 further comprising another LED unit fixed to the housing, wherein the LED unit and the another LED unit are separated from each other by a clapboard received in the housing.

18. The LED lamp as claimed in claim 16, wherein the LED unit further comprises a light-guiding cover fixed on the plate, the LEDs of the plurality of LED modules being exposed in the light-guiding cover.

19. The LED lamp as claimed in claim 18, wherein the light-guiding cover has a plurality of spots recessed to form vents, the LEDs of the plurality of LED modules being received in the vents, respectively.

20. The LED lamp as claimed in claim 19, wherein a caliber of the vent increases along a direction remote from the LEDs.

* * * * *